United States Patent [19]

Smrt

[11] 4,009,543

[45] Mar. 1, 1977

[54] GEODESIC DOME

[76] Inventor: Thomas J. Smrt, 31W 300 W. Bartlett Road, Bartlett, Ill. 60103

[22] Filed: May 15, 1975

[21] Appl. No.: 577,762

[52] U.S. Cl. ..... 52/81; 52/222; 52/582; 52/475

[51] Int. Cl.[2] ..... E04B 1/32

[58] Field of Search ..... 52/81, 648, 493, 475, 52/237, 82, 731, 732, 649, 73, 222, 595, 582; 403/176, 171, 172

[56] References Cited

UNITED STATES PATENTS

| | | | |
|---|---|---|---|
| 3,255,556 | 6/1966 | D'Amato et al. | 52/81 |
| 3,314,199 | 4/1967 | Wolf, Jr. et al. | 52/82 |
| 3,323,820 | 6/1967 | Braccini | 52/81 X |
| 3,332,197 | 7/1967 | Hinkle | 52/732 X |
| 3,513,608 | 5/1970 | Nagrod | 52/82 |
| 3,535,844 | 10/1970 | Glaros | 52/595 |
| 3,660,952 | 5/1972 | Wilson | 52/595 X |
| 3,757,479 | 9/1973 | Martinez | 52/222 |

*Primary Examiner*—Price C. Faw, Jr.
*Assistant Examiner*—Carl D. Friedman

[57] ABSTRACT

A geodesic dome is formed from a plurality of triangles. Each triangle comprises three hollow struts with depending flanges and one or two sheets which are secured to the struts. The area within the struts can be filled with insulation.

3 Claims, 30 Drawing Figures

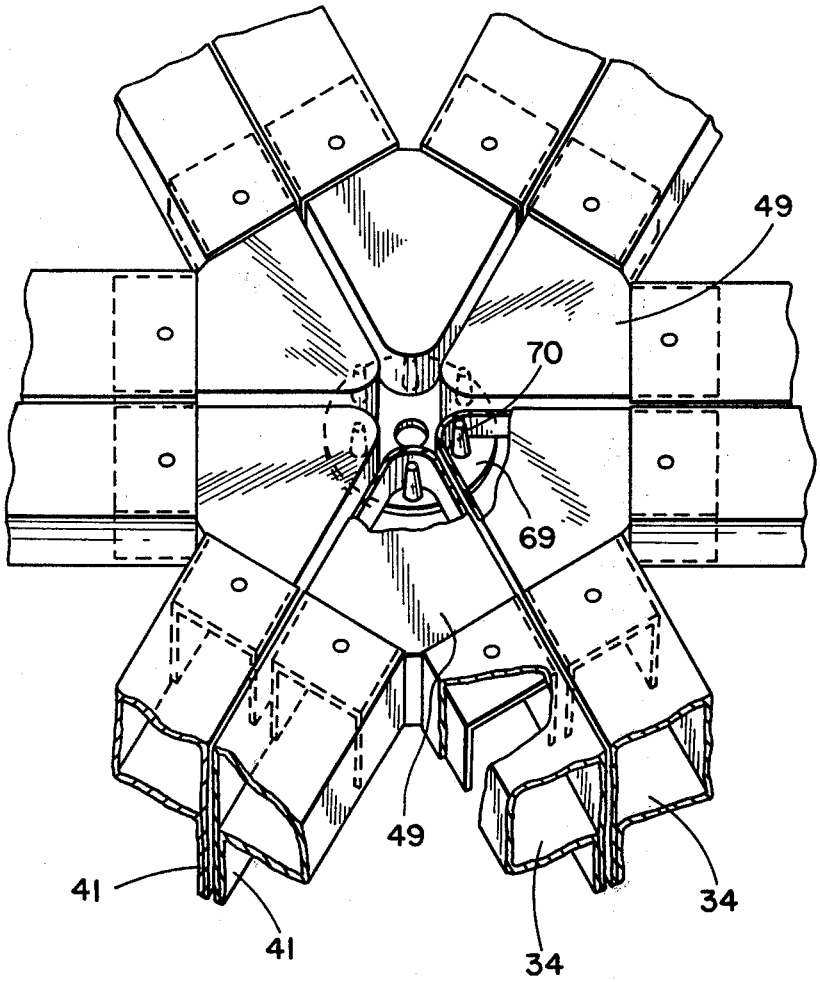
FIG.6
FIG.8
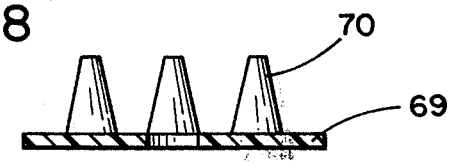
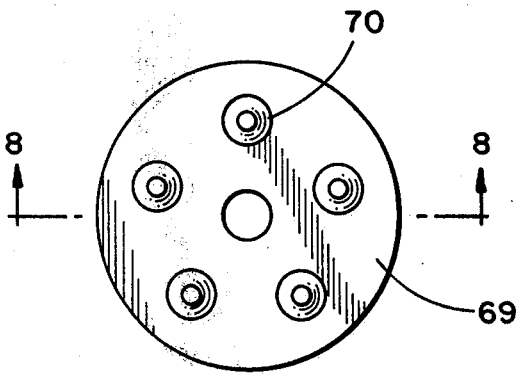
FIG.7
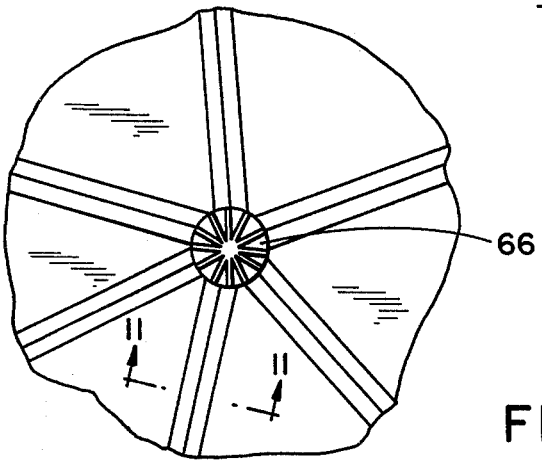
FIG.9

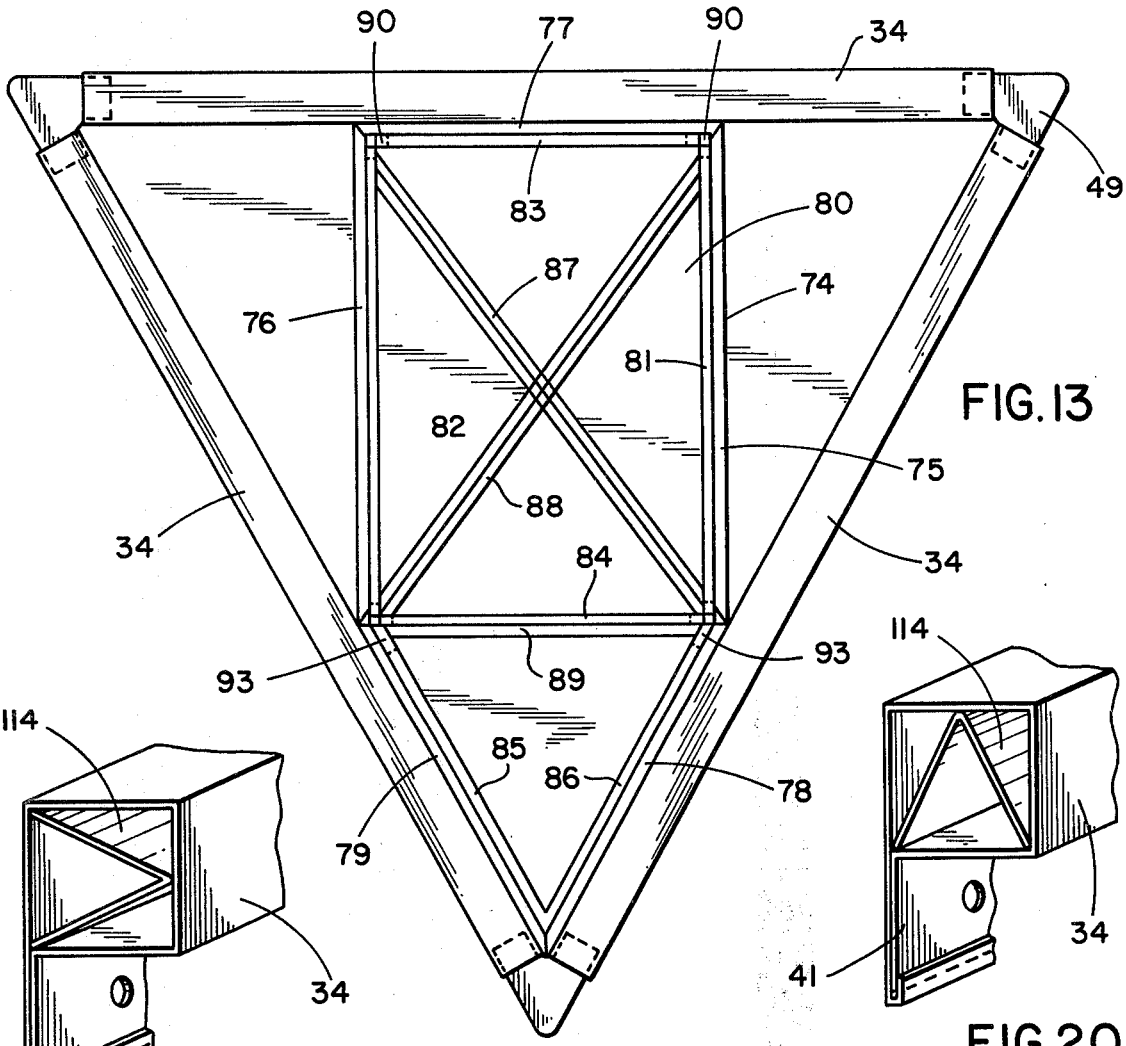
FIG. 13
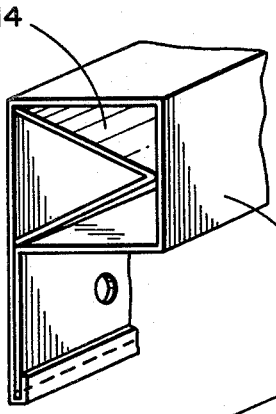
FIG. 17
FIG. 20
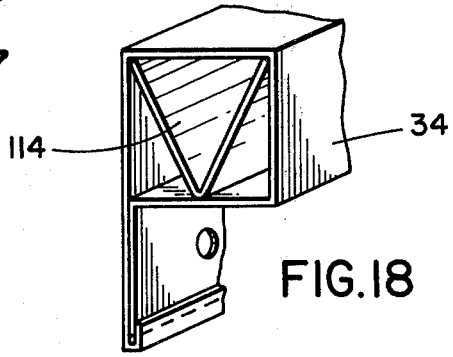
FIG. 18
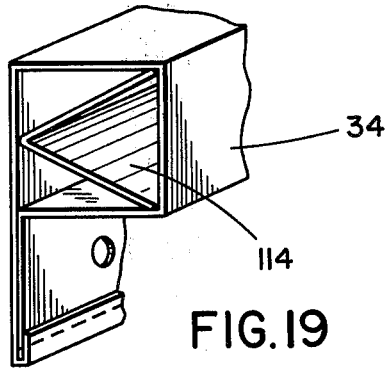
FIG. 19
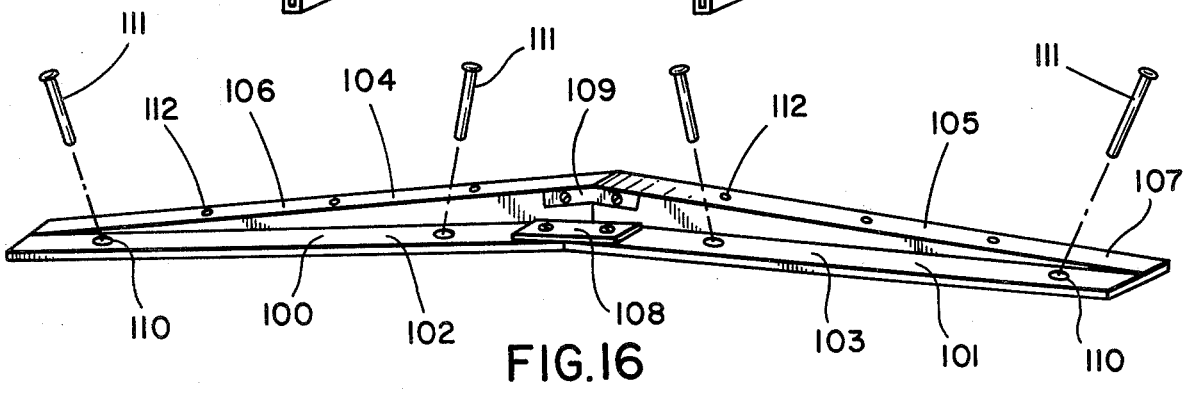
FIG. 16

GEODESIC DOME

BACKGROUND AND SUMMARY

This invention relates to geodesic domes, and, more particularly, to a geodesic dome which can be assembled quickly and easily but which possesses excellent strength and structural integrity.

Geodesic domes which are formed from a plurality of triangles are well known. These domes are assembled by joining the individual triangles to adjacent triangles to form an integrated structure. However, in order to insure that the triangles are securely joined, the assembly procedure is often time-consuming and tedious.

The invention provides a geodesic dome which can be assembled easily and rapidly, a dome whose triangles are securely joined, and a dome which is lightweight yet extremely strong. Each triangle is formed from three struts, each of which has a hollow, polygonal cross section for providing maximum strength with a minimum of weight, and a flange portion which extends away from the polygonal cross section. The flanges permit adjacent triangles to be quickly secured by bolting abutting flanges together, an additional securement is provided by fasteners which clamp the apices of a number of adjacent triangles. Because each triangle is independently secured to three adjacent triangles by means of the flanges, any triangle can easily be removed to permit the insertion of a window, ventilator, or the like.

DESCRIPTION OF THE DRAWING

The invention will be explained in conjunction with illustrative embodiments shown in the accompanying drawing, in which:

FIG. 6 is a fragmentary perspective view, partially broken away, of one of the junctions of the apices of adjacent triangles;

FIG. 7 is a top plan view of the fastener illustrated in FIG. 6;

FIG. 8 is a sectional view taken along the line 8—8 of FIG. 7;

FIG. 9 is a plan view of one of the junctions of the apices of adjoining triangles illustrating the umbrella-type fastener for the junctures;

FIG. 13 is an enlarged view of the triangle which includes the door for the dome;

FIG. 16 is an exploded view of the anchor and spacer which is used to secure some of the triangles to the supporting surface for the dome;

FIGS. 17–20 are fragmentary perspective views illustrating various positions of a V-shaped reinforcer positioned within a strut;

DESCRIPTION OF SPECIFIC EMBODIMENTS

Figure 1:
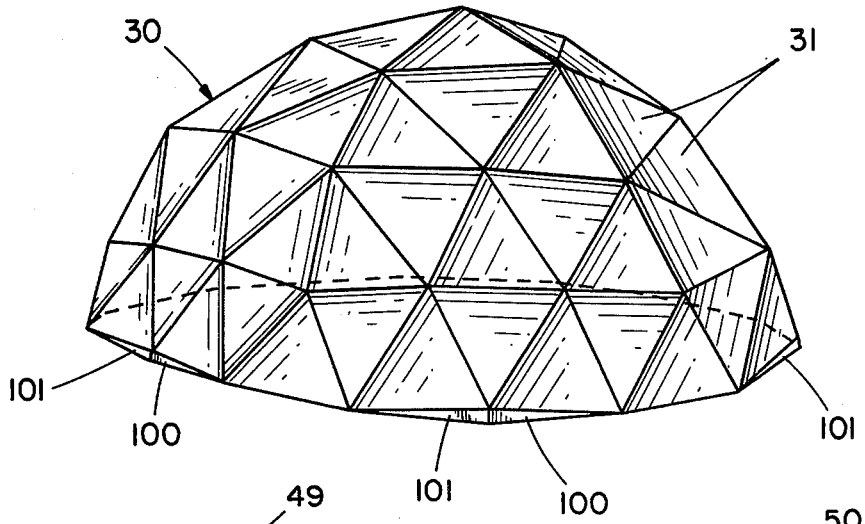
FIG. 1 is a perspective view of a geodesic dome constructed in accordance with the invention.

Referring first to FIG. 1, the numeral 30 designates generally a geodesic dome which is formed from a number of triangles 31 which are joined together to provide an integrated structure.

Figure 2:
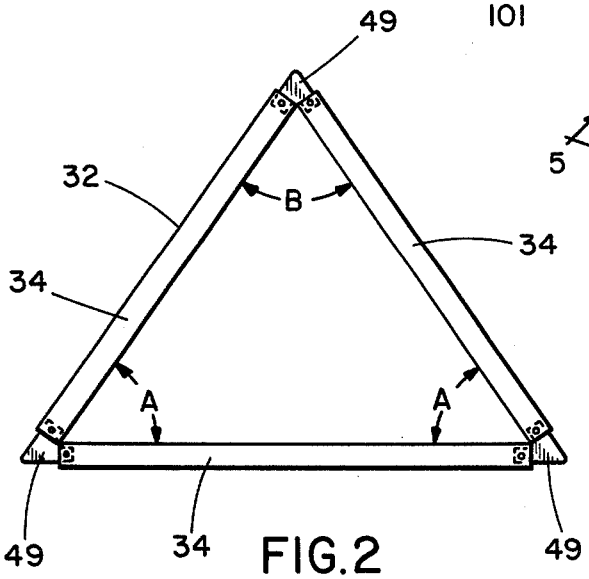
FIG. 2 is a plan view of one of the two sizes of triangles used to construct the dome.
Figure 3:
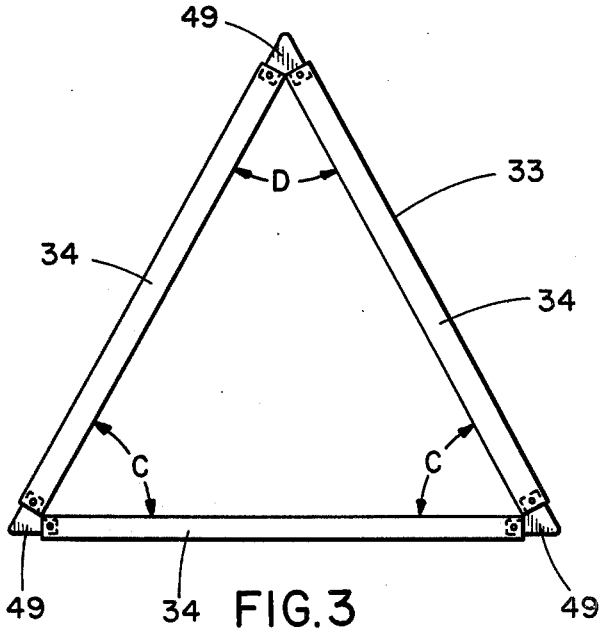
FIG. 3 is a plan view of the other size triangle used to construct the dome.
Figure 5:
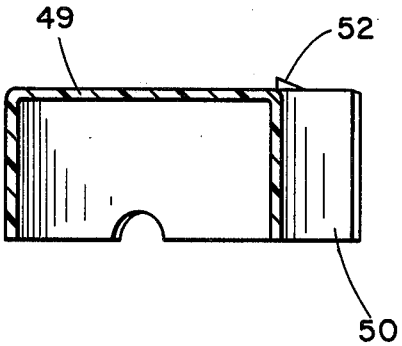
FIG. 5 is a sectional view taken along the line 5—5 of FIG. 4.

The dome 30 utilizes two types of triangles, a relatively small triangle 32 illustrated in FIG. 2, and a larger triangle 33 illustrated in FIG. 3. The triangle 32 is formed from three struts 34 which are joined together to provide the triangle with two equal angles A of 54.63° and an angle B of 70.72°. The triangle 33 is formed from three struts 34 which are joined together to form two equal angles C of 60.70° and an angle D of 58.58°. Each of the struts 34 are identical except for the length that is required to provide the desired angles. Thirty of the small triangles 32 and 45 of the large triangles 33, or a total of 75 triangles, are used to form the dome 30. The angles A and B of the small traingles and the angles C and D of the large triangles remain constant as the sizes of the triangles are varied to provide domes of varying sizes, only the lengths of the struts changing. However, the proportions of the two triangles remain the same. The bottom strut 34 of the triangle 32 has the same length as the bottom strut of the triangle 33.

Figure 24:
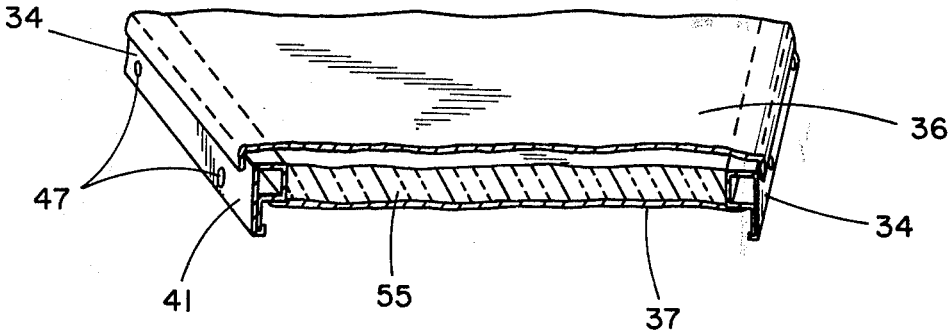
FIG. 24 is a fragmentary perspective view of one of the triangles of FIG. 1.

As will be explained more fully hereinafter, each triangle is covered by upper and lower plastic sheets 36 and 37 (FIG. 24) which are suitably secured to the struts before the triangles are joined together. However, for clarity of illustration, these sheets are omitted in FIGS. 2 and 3 as well as most of the other figures.

Figure 4:
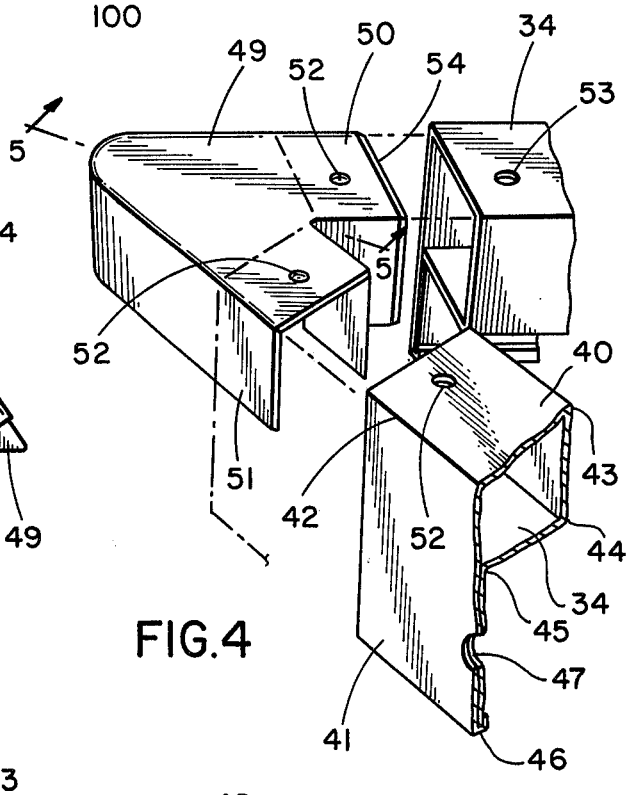
FIG. 4 is an exploded perspective fragmentary view of one of the apices of one of the triangles showing a connector for the struts.

Referring now to FIG. 4, each strut 34 includes a hollow body portion 40 having apolygonal cross-section and a depending flange portion 41. The strut 34 illustrated is formed from a sheet of aluminum which is formed to provide corners 42, 43, 44, and 45 and a double-thickness flange 41. The bottom of one of the thicknesses of the flange is bent upwardly at 46 and clamped against the other thickness. The flange 41 is provided with a plurality of longitudinally spaced openings 47 (see also FIG. 24), which are used to connect the flanges of adjacent triangles in assembling the dome.

In the particular embodiment illustrated in FIGS. 2–4, each triangle includes three molded plastic V-shaped connectors 49 which have a pair of diverging channel-shaped leg portions 50 and 51. Four types of connectors are used for the two triangles 32 and 33 which are identical except for the angle between the divering legs 50 and 51, the angle corresponding to the desired angle A, B, C, or D. Each leg of the connector includes a projection or tooth 52 which is adapted to be received in an opening 53 in the top of the strut when the leg is inserted into the strut. The legs 50 and 51 are sized to be snugly received by the hollow struts 34, and the connectors are locked in place by the projections 52 which will snap through the openings 53 in the struts. The ends of each of the legs 50 and 51 are chamfered at 54 to facilitate the insertion of the connectors into the struts. Each triangle can be quickly assembled merely by selecting the appropriate type of connector and the appropriate lengths of struts and snapping the connectors into the struts to form an integrated triangle. Each of the triangles is assembled by positioning the struts 34 so that the flange 41 of each strut extends downwardly along one of the outside edges of the triangle.

Figure 25:
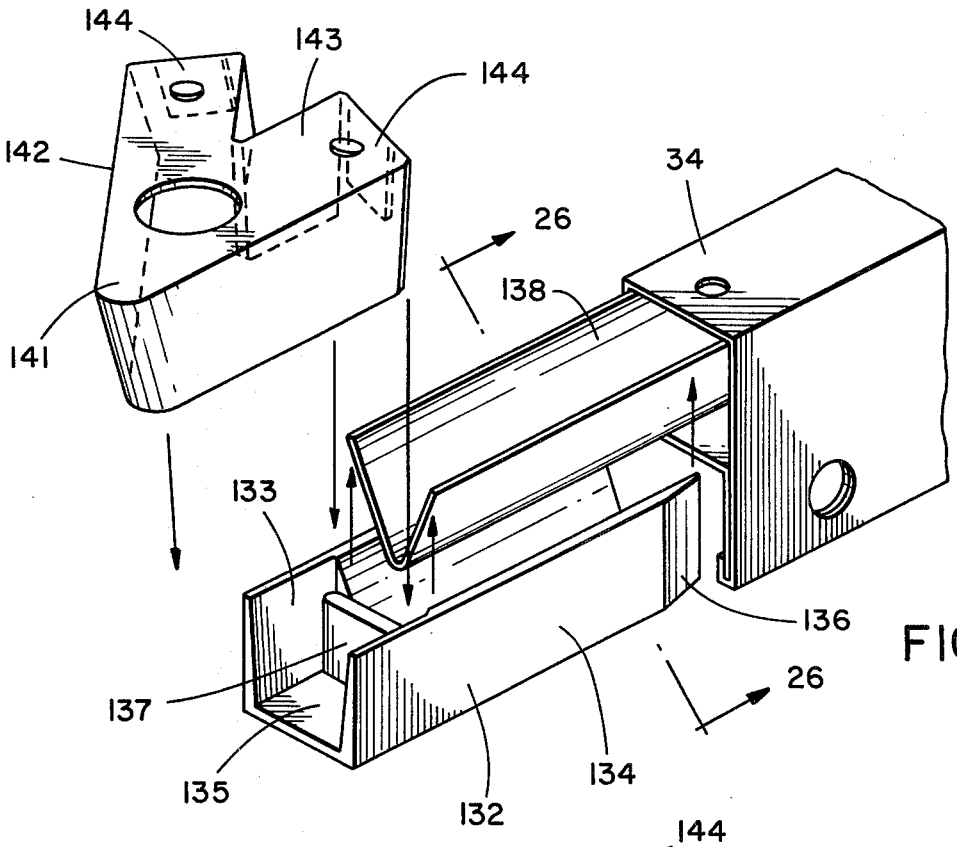
FIG. 25 is an exploded perspective view of an alternate means for securing the ends of the struts.

After the triangles are formed, inner and outer panels 36 and 37 are secured to the struts to cover the opening within each triangle (see FIG. 25). The panels can be made from flexible plastic sheets, plastic mesh, foil, or the like which are suitably secured, as by adhesive, to the struts. In the embodiment illustrated in FIG. 24, foamed plastic insulation 55 is located between the plastic sheets 36 and 37.

The dome is assembled by arranging the triangles so that struts of equal length abut each other, and the abutting struts of adjacent triangles are then secured by fasteners 58 (FIGS. 11 and 12) which extend through aligned openings 47 in the abutting flanges. Each fastener includes a bolt 59 having a threaded shank 60 which extends through the openings 47 and a nut 61 which is threaded onto the shank to clamp the two abutting flanges 41 together. The adjacent struts may also be secured by a strip of adhesive applied between the abutting outer sheets 36, and the adhesive will also serve to seal the space between the triangles.

As the assembly of the dome progresses, the apices of connected triangles will meet at junctions throughout the surface of the dome, one of which is illustrated in FIG. 6. The apices of either five or six triangles will meet at each junction, depending upon the number of large and small triangles 32 and 33 at each junction. In FIG. 6, the apices of six triangles meet.

Figure 10:
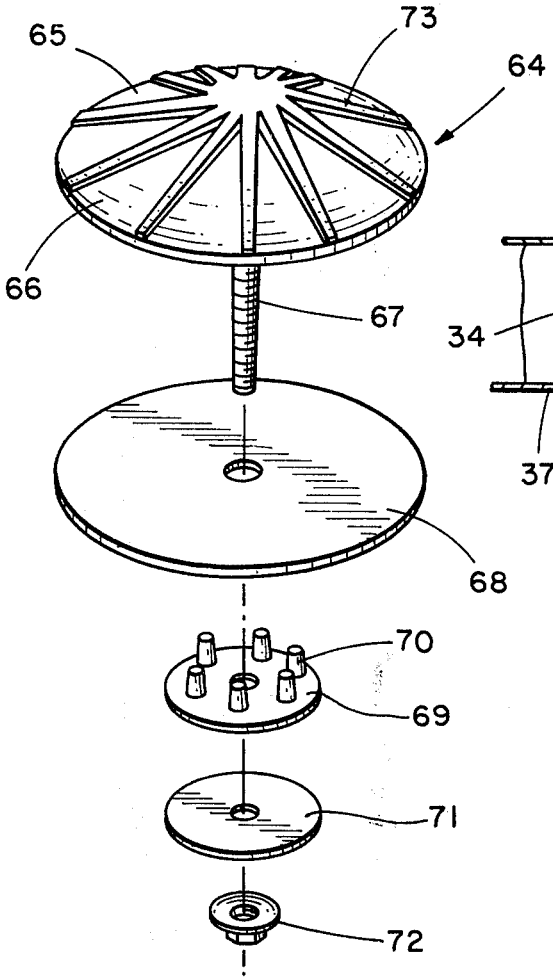
FIG. 10 is an exploded view of the umbrella-type fastener which includes the fastener illustrated in FIGS. 7 and 8.

The triangles are further secured at these junctions by a fastener designated generally by the numeral 64 in FIG. 10. This fastener includes an umbrella pin 65 having a decorative generally circular top 66 and a stem 67, a washer 68, a clamping plate 69 which includes a plurality of upstanding projections 70, a washer 71, and a nut washer 72. Two styles of clamping plates 69 are used, one having five equally spaced projections 70 and another having six equally spaced projections 70. A five or six projection plate is used depending upon the number of triangles which meet at the junction. In FIG. 6, six triangles meet at the junction, so a clamping plate 69 having six projections 70 is used. The clamping plate is positioned on the inner side of the triangles so that the projections extend upwardly into the open bottom of each of the connectors 49 adjacent the apex of each of the V-shaped connectors, and the spacing between the projections is such that the apices of the triangles are restrained from moving away from each other. The washer 68 and umbrella pin 65 are then positioned on the outer surfaces of the triangles so that the stem 67 extends through the opening in the plate 69, and the nut 72 is then threaded onto the stem 67 to clamp the fastener together against the connectors.

The completed juncture is illustrated in FIG. 9, and the top 66 of the umbrella pin completely covers the opening where the apices of the triangles meet. Further, the umbrella pin is provided with decorative radially extending ribs 73 (FIG. 10) to provide an aesthetically pleasing appearance.

A door structure for the dome is illustrated in FIG. 13. A door frame 74 is secured to the struts 34 of the triangles at the bottom of the dome. The door frame 74 includes a pair of vertically extending tubular braces 75 and 76, an upper horizontally extending tubular brace 77, and a pair of downwardly converging tubular braces 78 and 79. The downwardly extending tubular braces 78 and 79 are secured to the adjacent struts 34, and the upper horizontal brace 77 is secured to the upper strut 34. Each end of each brace of the door frame is connected to the adjacent end of the adjacent brace. A door 80 is hingedly secured to one of the vertically extending tubular frame members 81 and 82, a pair of horizontally extending tubular frame members 83 and 84, and a pair of downwardly converging frame members 85 and 85. The rectangular portion of the door is strengthened by cross braces 87 and 88, and the triangular portion of the door is reinforced by a horizontal brace 89.

Figure 14:
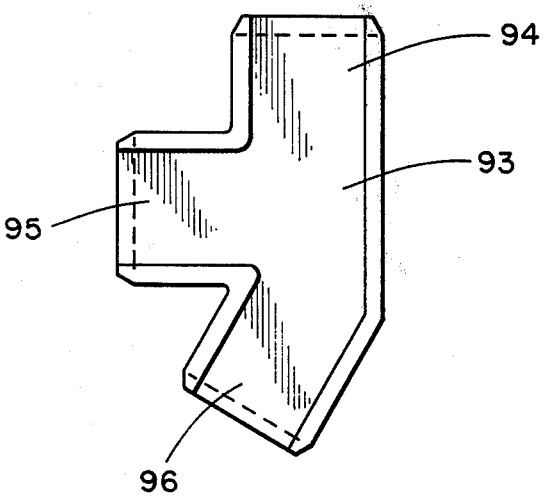
FIG. 14 is an enlarged plan view of one of the connectors illustrated in FIG. 13.
Figure 15:
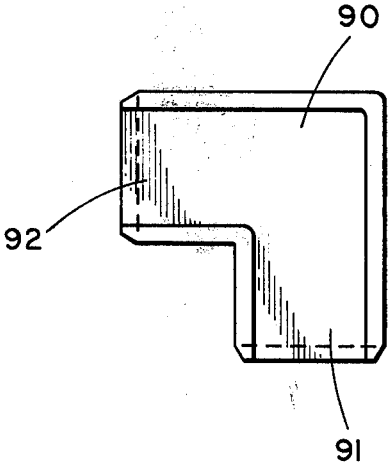
FIG. 15 is an enlarged plan view of one of the connectors illustrated in FIG. 13.

Each of the vertically extending frame members 81 and 82 of the door is joined to the upper horizontal frame member 83 by an L-shaped plastic connector 90 (see also FIG. 15) which is snugly received by the tubular frame members. The lower ends of the vertical frame members 81 and 82 are secured to the lower horizontal frame member 84 and the downwardly converging frame members 85 and 86 by generally T-shaped connectors 93 (see also FIG. 14). Each connector 93 includes three legs 94, 95, and 96 which have cross sections corresponding to the cross sections of the tubular frame members, and each leg is snugly received by one of the tubular frame members.

The door can be covered by panels which are secured to the frame members, and the opening within the triangle between the struts 34 and the door frame can be covered by panels or plastic sheets in the manner previously described.

The manner of securing the dome to the supporting surface, such as a concrete slab, ground, or the like and for filling the spaces between some of the bottom triangles and the supporting surface will be described with reference to FIG. 16. A right anchor 100 and a left anchor 101 are each formed from wood and include flat horizontal base portions 102 and 103, respectively, vertically extending, triangularly shaped riser portions 104 and 105, respectively, and inclined flat upper surfaces 106 and 107, respectively. The right and left anchors are joined by metal straps 108 and 109 which are bolted to the anchors. Each of the base portions 102 and 103 is provided with a plurality of openings 110 through which earth augers 111 can be inserted, and each of the flat upper surfaces 106 and 107 is provided with a plurality of lag bolt holes 112 which are positioned to align with the openings 47 in the triangle struts 34.

Figure 11:
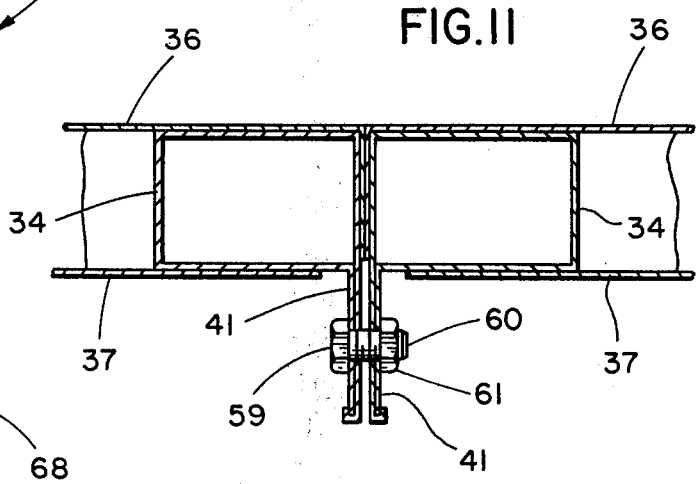
FIG. 11 is an enlarged sectional view taken along the line 11—11 of FIG. 9.
Figure 12:
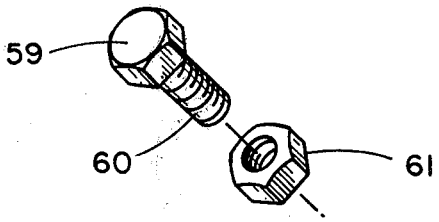
FIG. 12 is an exploded view of the fastener illustrated in FIG. 11.

As can be seen in FIG. 1, the bottom strut of every third triangle around the lower periphery of the dome extends substantially horizontally and parallel to the supporting surface for the dome. The bottom struts of the two intervening triangles are inclined slightly from the supporting surface, and the right and left spacers are shaped to fill this space and to secure these triangles to the supporting surface. The right and left spaces are slightly skewed with respect to each other to correspond to the skew between the associated triangles, and the spacers can be suitably joined together, as by soldering, welding, or the like. The spacers are secured to the bottom struts of the triangles in the same manner as the struts of adjacent triangles are secured as illustrated in FIG. 11. The holes in the upper flat surfaces 106 and 107 of the anchors are aligned with the holes 47 in the flange 41 of the triangle immediately thereabove, and the flange and the anchor are secured by a bolt 59 and wing nut 61. The anchor is secured to the ground or other supporting surface by the stakes 111 which are driven through the openings 110. The stakes illustrated in FIG. 16 are driven at various angles to increase the holding power of the stakes.

FIGS. 17–20 illustrate the use of a reinforcing V-shaped metal angle 114 which is inserted into the hollow strut 34 to maintain strut strength as the size of the dome is increased. The manner in which the strut is inserted can be varied as desired to give strength and stability in the direction needed. The angles 114 illustrated in FIGS. 17 and 19 are used to provide strength and resistance against strut bowing when the triangles are assembled into a dome. The angle 114 illustrated in FIG. 18 is used primarily for strength against a snow load situation or other weight factor such as exterior-pressure. The angle 114 illustrated in FIG. 20 is an alternate to the configureation of FIG. 18 and is useful to provide strength in situations such as a high wind that creates pressure on the inside of the dome. If desired, the angle 114 illustrated in FIG. 20 can be modified so that the left leg of the angle extends downwardly between the two layers of the flange 41.

Figure 21:
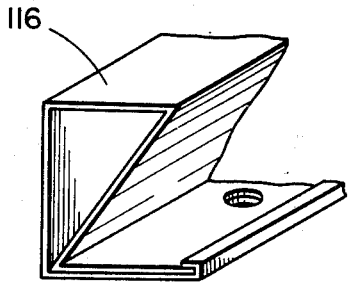
FIG. 21 is a fragmentary perspective view of a modified strut.
Figure 22:
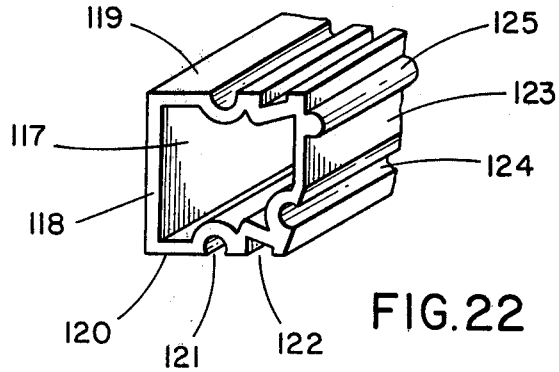
FIG. 22 is a fragmentary perspective view of an embodiment of an extruded strut.

FIGS. 21 and 22 illustrate modified embodiments of struts 116 and 117. The strut 116 is somewhat similar to the strut 34 previously described except that the hollow tubular portion has a triangular cross section. Other polygonally shaped cross sections can be used, but square, rectangular, and triangular are the easiest to form.

The strut 117 illustrated in FIG. 22 is formed of extruded aluminum, plastic, or other suitable material. The strut includes a flat inner wall 118, upper and lower walls 119 and 120, each of which is provided with a generally semicircular groove 121 and a trapezoidally shaped groove 122, and an outer wall 123 which is provided with a generally semicircular groove 124 in a generally semicircular outwardly projecting rib 125.

Figure 23:
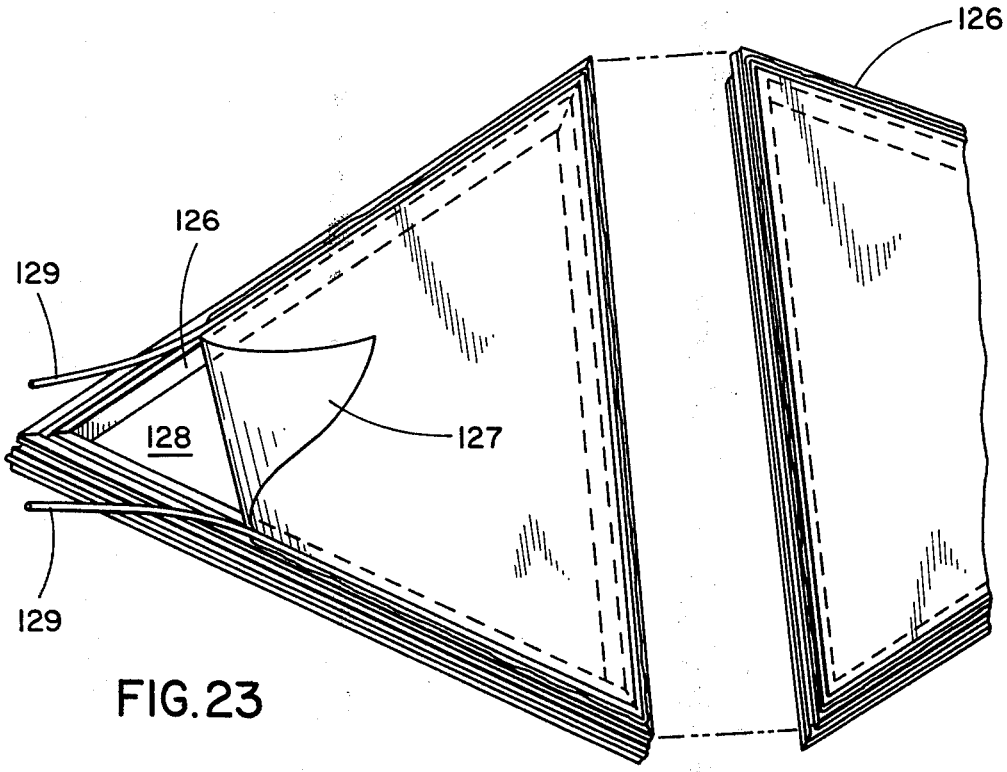
FIG. 23 is a perspective view of a pair of triangles formed from the extruded struts of FIG. 22 in the process of being joined.

Three struts 117 are connected to form triangles 126 such as illustrated in FIG. 23. The triangles are shaped the same as the triangles 32 and 33 illustrated in FIGS. 2 and 3, and the ends of the struts are mitered and suitably secured. The opening of each triangle is covered by upper and lower plastic sheets 127 and 128 which are secured to the struts by flexible plastic tubes 129 which are press fitted into the grooves 121 in the struts to frictionally retain the sheets therein. If desired, the space between the sheets can be filled with insulation.

The triangles are connected by inserting the ribs 125 on the struts of adjacent triangles into the correspondingly shaped grooves 124. For this purpose, adjacent triangles are flipped with respect to each other so that the rib of each triangle is aligned with the strut of the adjacent triangle.

When extruded struts are used, a piece of metal or other reinforcing material can be bent to the appropriate shape and inserted into the struts in a manner similar to that described with respect to FIGS. 17–20.

Figure 26:
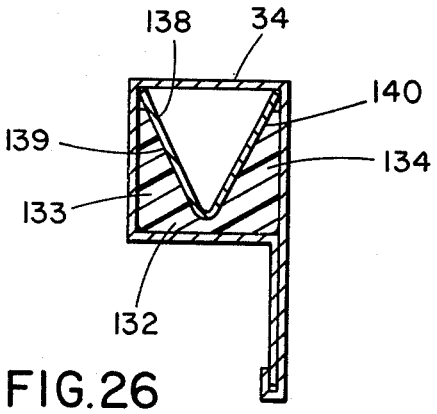
FIG. 26 is a sectional view as would be seen along the line 26—26 of FIG. 25 when the various parts are assembled.

FIG. 25 illustrates a molded plastic corner extension 132 which can be used to further reinforce and strengthen the dome. The corner extension is generally channel-shaped and includes a pair of upwardly extending side walls 133 and 134 and a bottom wall 135. One end of the side walls are chamfered at 136 to facilitate insertion of the corner extension into the hollow strut 34, and a transverse wall 137 extends between the side walls adjacent the other end of the corner extension. The corner extension is designed for use with a V-shaped reinforcing angle 138 which is inserted into the hollow cross section of the strut, and the side walls 133 and 134 of the corner extension are provided with V-shaped converging inner surfaces 139 and 140 (FIG. 26) which nest with the angle 138. Before the corner extension is inserted into the tubular strut, the mating surfaces of the angle 138 and the corner extension are advantageously secured together, as by adhesive.

Figure 27:
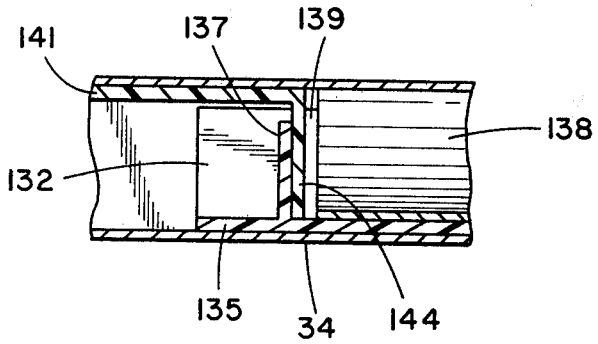
FIG. 27 is a sectional view as would be seen along the line 27—27 of FIG. 25 when the parts are assembled.

A connector 141 similar to the connector 49 previously described is used to connect adjacent struts of each triangle. However, each of the legs 142 and 143 of the connector include a tab 144 which extends downwardly from the end of the leg and which is adapted to abut the transverse wall 137 of the corner extension when the connector is inserted over the outer end of the corner extension (see FIG. 27).

After the connector is inserted over the corner extension, the connector and corner extension are inserted into the tubular strut. The angle 138 can be secured to the corner extension either before or after the corner extension is inserted into the strut. At the first end of a strut which is to be connected, the angle can be withdrawn slightly from the strut and secured to the corner extension. At the opposite end, the adhesive can be applied to the corner extension, and the corner extension can then be pushed into the strut so that the angle will seat within the V-shaped surfaces of the corner extension.

The interrelationship between the corner extension, the angle, and the connector prevent both a rotation of the connector in the strut and a stretching effect at the corner junctions of the assembled dome.

Figure 28:
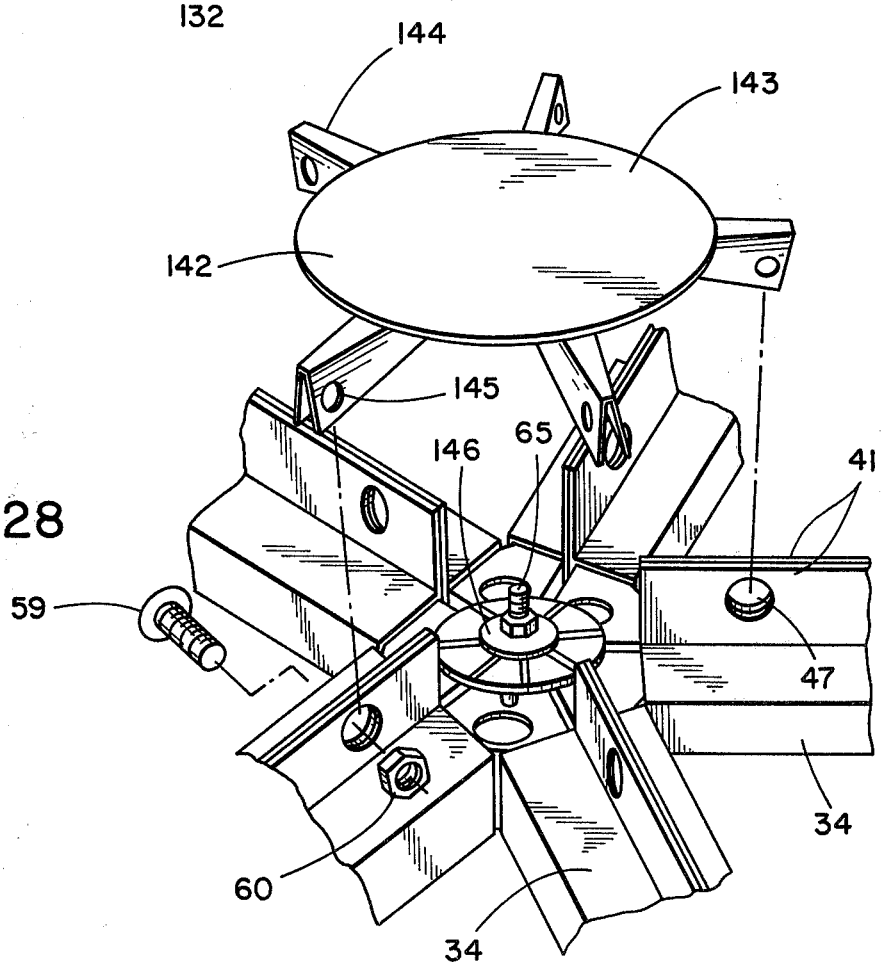
FIG. 28 is an exploded perspective view of a bracket for reinforcing the triangles at the junction of adjacent triangles.

A reinforcing bracket 142 for the junctions of adjacent triangles is illustrated in FIG. 28. The bracket includes a flat central hub or plate 143, and a plurality of bracket arms 144 which are secured to the plate and which extend radially outwardly. The bracket includes five or six bracket arms 144 depending upon whether it is to be used at a junction of five triangles or six triangles. Each of the bracket arms 144 is generally channel-shaped and is sized to fit over the abutting flanges 41 of the adjacent triangle struts. After the triangles are assembled, the flange fasteners 58 (FIG. 11) which are closest to the junction are removed, and the bracket 142 is positioned so that each of the bracket arms is inserted over a pair of abutting flanges. Each bracket arm is provided with an opening 145 which aligns with the openings 47 in the flanges, and the bolts 59 and nuts 60 are replaced to secure the bracket. A washer nut 146 is used to secure the umbrella fastener 65.

Figure 29:
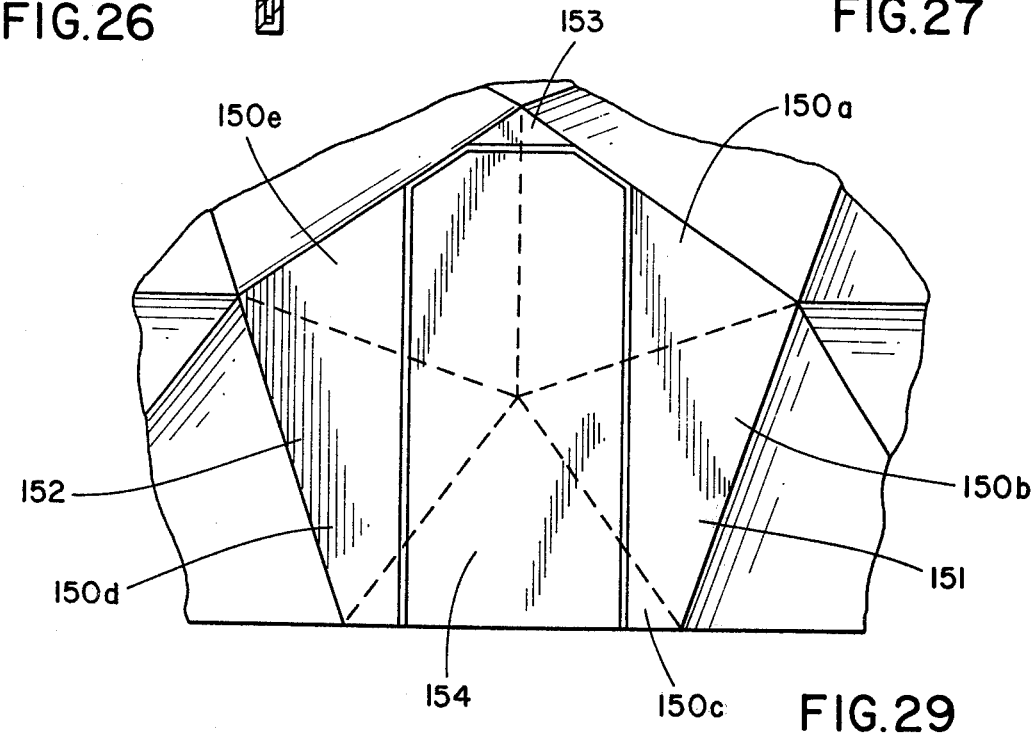
FIGS. 29 and 30 are fragmentary elevational views showing alternate embodiments of the door structure.
Figure 30:
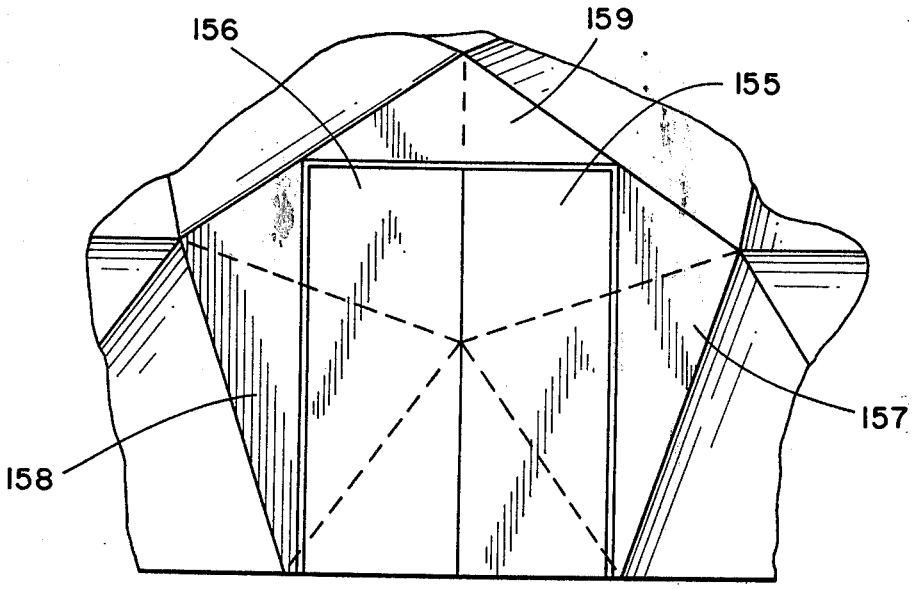

Alternate door structures are illustrated in FIGS. 29 and 30. Referring first to FIG. 29, five triangles 150*a*, 150*b*, 150*c*, 150*d*, and 150*e* which form a pentagon in the geodesic dome are removed and replaced by wood pieces 151, 152, 153, and 154. The pieces 151–153 are fastened to the adjacent triangles, and the piece 154 forms a door and is hingedly secured to either of the pieces 151 and 152. The wood pieces can be secured to the adjacent triangles in any suitable fashion, as by bolting the wood to the struts of the triangles in the same way as the triangles are bolted together.

FIG. 30 illustrates a similar door structure in which a pair of doors 155 and 156 are used. The door 155 is hingedly secured to wood piece 157 which is secured to the struts of the adjacent triangles, and the door 156 is hingedly secured to a wood piece 158 which is secured to the adjacent triangles. The upper portion of the pentagonal opening in the dome created by the removal of the five triangles is filled by a triangular piece of wood 159.

While in the foregoing specification detailed descriptions of specific embodiments of the invention have been set forth for the purpose of illustration, it is to be understood that many of the details hereingiven may be varied considerably by those skilled in the art without departing from the spirit and scope of the invention.

I claim:

1. A geodesic dome formed from a plurality of structural triangles, each triangle having three apices, three struts joined together at the apices, and a panel member secured to the struts and covering the area within the struts, each strut having a hollow rectangular cross section and a flange portion positioned on the outside of the triangle, the flange portion of each strut of each triangle being secured to a flange portion of an adjacent strut, a generally V-shaped reinforcing member positioned within each strut, each triangle including three V-shaped connectors and a corner extension at each end of each strut, each corner extension being generally channel-shaped in cross section and having a pair of end portions, one of the end portions being received within one of the hollow struts and having a pair of inclined inner surfaces mating with the V-shaped reinforcing member, each connector having a pair of legs which are received by two adjacent struts of the triangle at one of the apices of the triangle, each leg including a downwardly extending tab, each connector including a transverse wall abutting the tab of the associated connector and restraining outward movement of the connector from the strut.

2. A geodesic dome formed from a plurality of structural triangles, each triangle having three apices, three elongated struts joined together at the apices, and a planar panel secured to the struts and covering the area within the struts, each strut having a longitudinally extending hollow body portion having a polygonal transverse cross section and a longitudinally extending flange portion on the outside of the triangle which extends from the body portion generally transversely to the plane of the panel, the flange portion of each strut of each triangle being secured to a flange portion of an adjacent strut of another triangle and a plurality of anchors around the periphery of the bottom of the dome, each anchor having a generally horizontally extending base portion secured to the surface which supports the dome and a pair of triangular riser portions which extend generally vertically upwardly from the base portion, each of the riser portions having a flat upper surface which is inclined upwardly from the base portion and which meets the flat upper surface of the other riser portion in the center of the anchor, each of the flat upper surfaces being secured to the flange of a strut of one of the triangles at the bottom of the dome whereby the dome is anchored to the supporting surface.

3. A geodesic dome formed from a plurality of structural triangles, each triangle having three apices, three elongated struts joined together at the apices, and a planar panel secured to the struts and covering the area within the struts, each strut having a longitudinally extending hollow body portion having a polygonal transverse cross section and a longitudinally extending flange portion on the outside of the triangle which extends from the body portion generally transversely to the plane of the panel, the flange portion of each strut of each triangle being secured to a flange portion of an adjacent strut of another triangle, the body portion of each strut being formed from a sheet of metal which is bent to form top, bottom, and opposite side walls which provide a rectangular transverse cross section, the flange portion of each strut being provided by a first edge portion of the sheet which extends downwardly from one of the side walls as a continuation thereof and a second edge portion of the sheet which extends downwardly from the bottom wall generally perpendicularly thereto, the first and second edge portions abutting each other and being secured together, each triangle including three V-shaped connectors, each connector having a pair of legs which are positioned within the hollow body portion of two adjacent struts of the triangle at one of the apices of the triangle and which are secured to the body portion.

* * * * *